US008189842B2

(12) United States Patent
Heil

(10) Patent No.: US 8,189,842 B2
(45) Date of Patent: May 29, 2012

(54) LOW HANDLING NOISE VOCAL MICROPHONE

(75) Inventor: Robert Heil, Belleville, IL (US)

(73) Assignee: Heil Sound, Ltd., Fairview Heights, IL (US)

( * ) Notice: Subject to any disclaimer, the term of this patent is extended or adjusted under 35 U.S.C. 154(b) by 660 days.

(21) Appl. No.: 12/291,567

(22) Filed: Nov. 12, 2008

(65) Prior Publication Data

US 2010/0119098 A1 May 13, 2010

(51) Int. Cl.
*H04R 9/08* (2006.01)

(52) U.S. Cl. ..... 381/368; 381/155; 381/355; 381/361

(58) Field of Classification Search ..... 381/361, 381/363, 368, 155, 355
See application file for complete search history.

(56) References Cited

U.S. PATENT DOCUMENTS

| | | | | |
|---|---|---|---|---|
| 5,148,492 | A | 9/1992 | Uzawa | |
| 5,363,452 | A | 11/1994 | Anderson | |
| 5,706,359 | A | 1/1998 | Chang | |
| 6,091,828 | A | 7/2000 | Akino | |
| 6,128,393 | A * | 10/2000 | Kondo | 381/368 |
| 6,549,632 | B1 | 4/2003 | Akino | |
| 2005/0157902 | A1 | 7/2005 | Akino | |
| 2005/0226450 | A1 | 10/2005 | Akino | |

* cited by examiner

*Primary Examiner* — Minh-Loan T Tran
*Assistant Examiner* — Fazli Erdem
(74) *Attorney, Agent, or Firm* — Bryan Cave LLP

(57) ABSTRACT

A handheld microphone includes a hollow cylindrical housing with a portion of a cylindrical shock mount device positioned within the top end thereof. The shock mount device incorporates an isolation band such that only the isolation band contacts the inner surface of the housing, thus dampening the external noises transmitted to the dynamic element of the microphone.

11 Claims, 4 Drawing Sheets

LOW HANDLING NOISE VOCAL MICROPHONE

FIELD OF THE INVENTION

This invention relates generally to handheld vocal microphones and, in particular, to a handheld microphone that may be subjected to substantial handling vibration and noise.

BACKGROUND OF THE INVENTION

Nearly all amplified microphones transmit handling noise during use, i.e., noise generated by rubbing or tapping the outside surface of the microphone. Cardioid microphones are especially susceptible to handling noise in the low frequency audio spectrum. Professional sound engineers often address this problem by reducing the low end response of the vocal microphone using an acoustical mixer. As most handling noise originating with a microphone is located within the 60-100 Hz region of the acoustical spectrum, and because the human voice has little usable content within that range, rolling off or eliminating acoustical energy under 100 Hz substantially reduces the handling noise.

Another approach for reducing handling noise when using handheld microphones involves mechanically isolating or reducing vibrations using shock mount devices. Such shock mount devices typically include elastic material inserted into the microphone housing to reduce the amount of vibration and noise transferred from the housing to the active elements of the microphone. The conventional shock mount devices are inserted into the housing in contact with the inner surface of the housing and hold some or all of the electro-magnetic elements of the microphone. However, any vibrational or acoustical energy imparted onto the housing will be transferred to the shock mount device and, although attenuated, will be transferred to the active elements of the microphone. A need exists, therefore, for an improved handheld microphone that substantially reduces low frequency handling noise.

SUMMARY OF THE INVENTION

According to one aspect of the present invention, a handheld microphone includes a hollow cylindrical housing having a top end and a cylindrical shock mount device having a lower portion positioned within the top end of the cylindrical housing. The shock mount device has an upper portion extending outwardly beyond the top end of the cylindrical housing. The lower portion of the shock mount device has an isolation band such that only the isolation band of the lower portion of the shock mount device contacts the inner face of the housing. A dynamic element is retained within the upper portion of the shock mount device. Reducing the amount of surface area of the shock mount device contacting the inner surface of the housing substantially decouples certain frequencies typically caused by handling of the microphone.

In one embodiment, the lower portion of the shock mount device has a generally convex outer surface forming the isolation band. Alternatively, the isolation band may be formed as a ring within the lower portion of the shock mount device.

BRIEF DESCRIPTION OF THE FIGURES

These and other features, aspects and advantages of the invention will become more fully apparent from the following detailed description, appended claims, and accompanying drawings, wherein the drawings illustrate features in accordance with an exemplary embodiment of the present invention, and wherein:

DETAILED DESCRIPTION OF THE INVENTION

Figure 1:
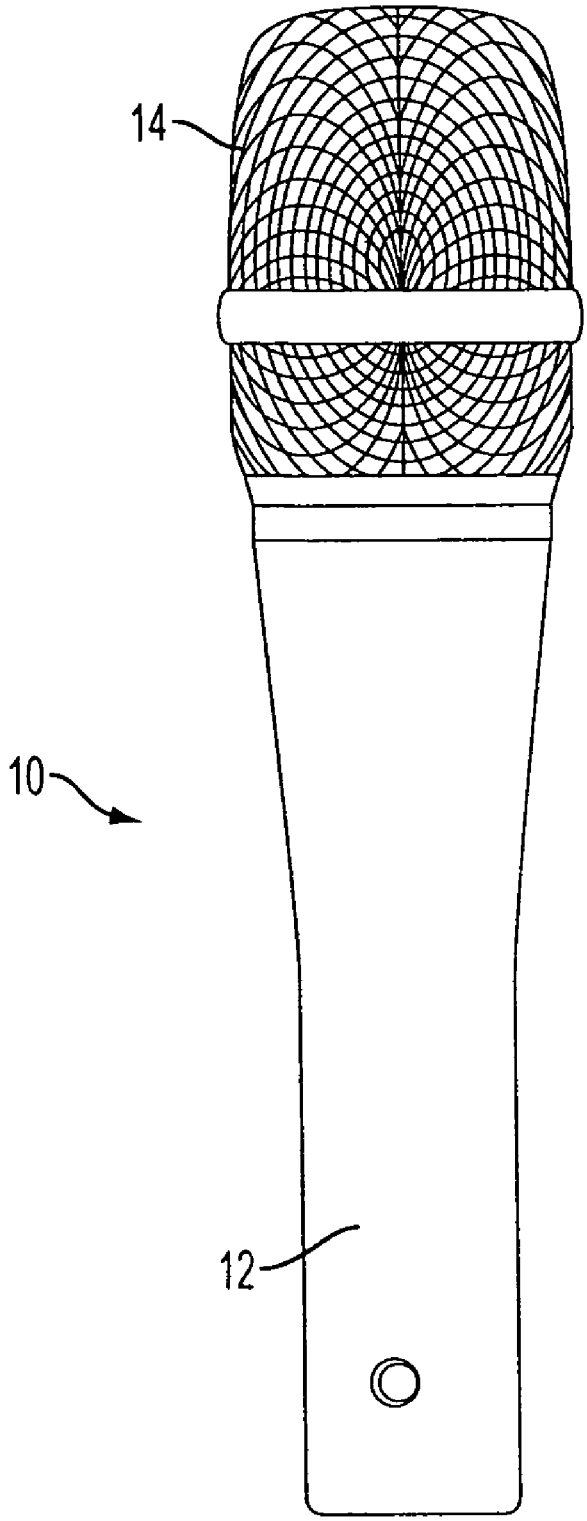
FIG. 1 is an illustration of the handheld microphone of the present invention.
Figure 2:
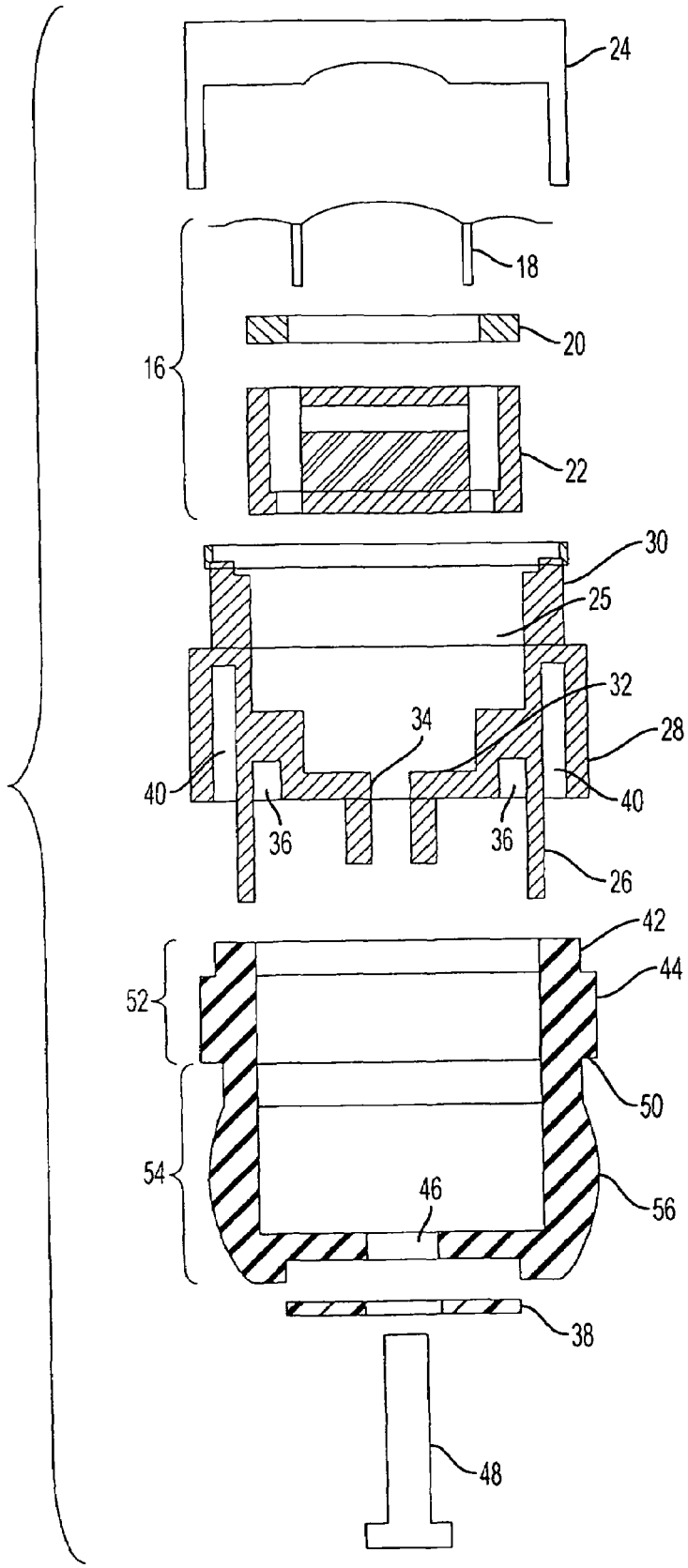
FIG. 2 is an exploded sectional view of the handheld microphone.
Figure 3:
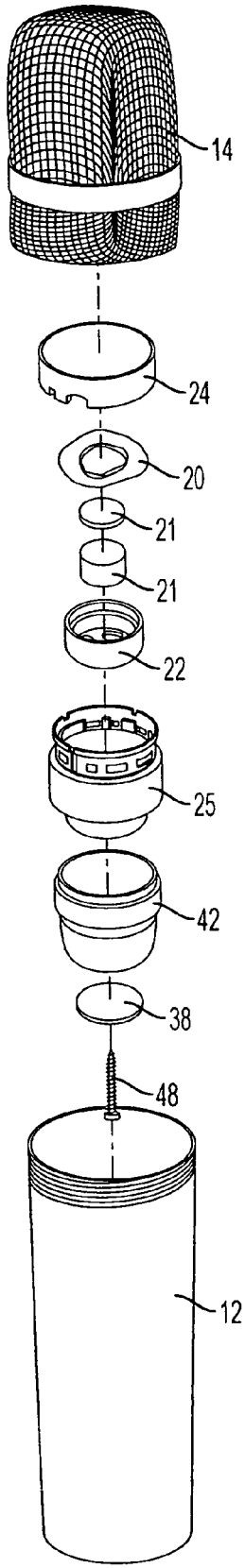
FIG. 3 is another exploded sectional view of the handheld microphone.

Referring to FIG. 1, the handheld microphone 10 includes a hollow housing 12 formed in a cylindrical shape having a perforated grille cap 14 attached thereto. For example, the grille cap 14 may be threaded to the housing 12. As illustrated in FIGS. 2 and 3, the housing 12 retains a dynamic element 16 that includes conventional elements such as a moving voice coil 18, a magnet loop 20, magnets 21 and a magnet assembly 22. The dynamic element 16 acts as a transducer to convert audio signals received through the grille cap 14 into electrical signals that are then fed onto an output lead. A diaphragm cover 24 mates with a magnet receptacle 25 in order to house the components of the dynamic element 16.

One embodiment of the magnet receptacle 25 includes three portions of varying outer diameters. The lower portion 26 has the smallest outer diameter. The middle portion 28 has the largest outer diameter, and the upper portion 30 has an intermediate outer diameter. A base 32 is formed in the interior of the magnet receptacle 25 and includes a threaded channel 34 and a series of holes 36 to allow wiring to pass from the dynamic element 16 to a printed circuit board 38. A circular channel 40 exists between the middle portion 28 and the lower portion 26. The magnet receptacle 25 may be made of plastic, for example, a synthetic resin. A cavity in the upper portion of the magnet receptacle 25 houses the dynamic element 16.

Low handling noise is achieved by mounting the magnet receptacle 25 containing the dynamic element 16 into a shock mount device 42. The shock mount device 42 is preferably fabricated from a visco-elastic polymer, preferably a thermoset, polyether-based polyurethane material such as Sorbothane brand polyurethane commercially available from Sorbothane, Inc. of Kent, Ohio. The shock mount device 42 is a generally hollow cylindrical element into the top end of which the magnet receptacle 25 is seated. Near the top of the integrally-molded shock mount device 42 is a ring 44. The portion of the shock mount device 42 above the ring 44 seats within the channel 40 of the magnet receptacle 25.

The bottom end of the shock mount device 42 includes a through-hole 46 axially aligned with the threaded channel 34 of the magnet receptacle 25. The printed circuit board 38 is seated into the bottom of the exterior of the shock mount device 42. A screw 48 may be threaded into a hole in the center of the printed circuit board 38, through the hole 46 in the bottom end of the shock mount device 42 and threaded into the channel 34 of the magnet receptacle 25 to secure the board 38 in place and to secure the magnet receptacle 25 to the shock mount device 42. The printed circuit board 38 may be connected electrically with the dynamic element 16 via wiring passing through holes 36.

The lower seat 50 of the ring 44 is designed to mate with the upper end of the housing 12 preferably such that no portion of the magnet receptacle 25 contacts the housing 12. After the device 42 is inserted into the housing 12, the upper portion 52 of the device 42 extends above the upper end of the housing and is enclosed by the grille cap 14. The lower portion 54 of the device 42 is contained within the interior of the housing 12.

Figure 4:
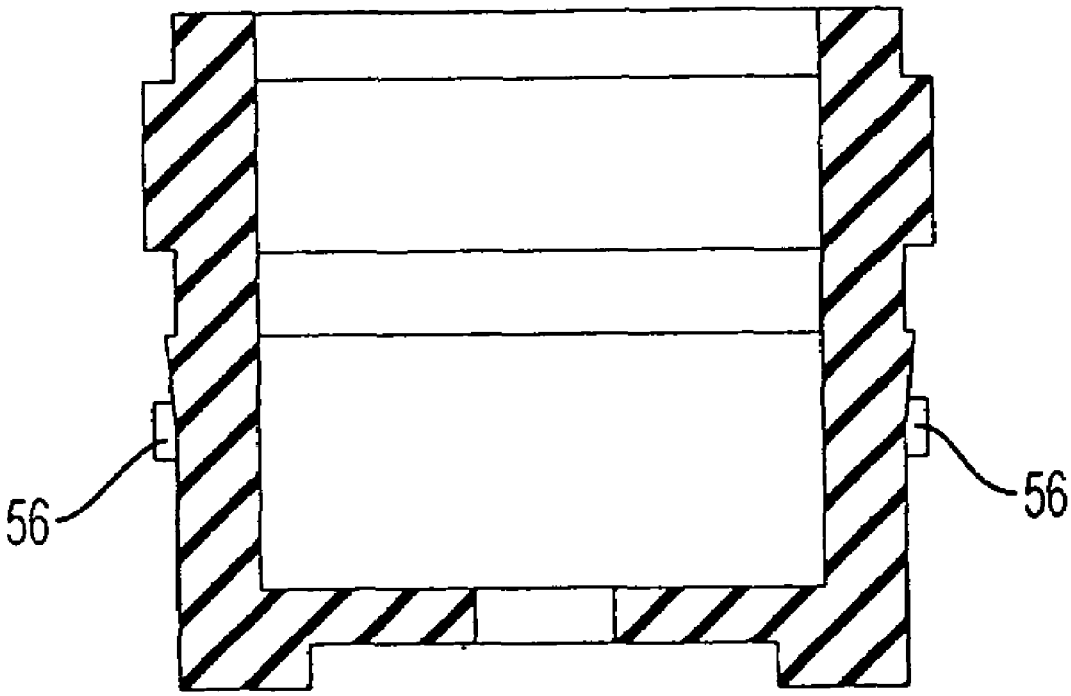
FIG. 4 illustrates an embodiment of the isolation band of the present invention.

The outer surface of the lower portion 54 of the shock mount device 42 has a unique geometry that greatly reduces the amount of handling noise passing from the housing 12 to the dynamic element 16. The lower portion 54 of the shock mount device 12 includes an isolation band 56 which reduces the amount of the exterior surface of the shock mount 42 that contacts the inner surface of the housing 12. Preferably, the isolation band 56 is the only portion of shock mount device 42 that contacts the inner surface or face of the housing 12. Thus, below the seat 50, the shock mount device 42 may have a generally convex outer surface such that the outer surface of the shock mount device 42 tapers outwardly (i.e., toward the inner surface of the housing 12 when the shock mount device 42 is placed into the housing 12) for a portion of the axial length of the lower portion 54 of the shock mount device 42 and then tapers inwardly toward the bottom of the device 12. In another embodiment, as illustrated in FIG. 4, the isolation band 56 may be an ring-type area of the lower portion 54 of the shock mount device 42 having a diameter larger (e.g., 4 mm) that the surrounding portion of the lower portion 54 of the device 42. In either of the described embodiments, the isolation band 56 may be formed integrally with the remainder of the lower portion 54 of the shock mount device 42. Those skilled in the art will appreciate that other embodiments for forming the isolation band 56 may be used, provided that the band meets the requirements of reducing the surface area of the shock mount device 42 in contact with the inner surface or face of the housing 12, while maintaining sufficient contact between the shock mount device 42 and the housing 12 to support the dynamic element 16.

Preferably, for a conventionally-sized handheld microphone (e.g., approximately eighteen cm in length), the shock mount device 42 may be approximately 25 mm in length, with approximately 75% of its length below the seat 50 (i.e., representing the lower portion 54). In this representative configuration, the isolation band 56 in contact with the inner surface of the housing 12 is in the range of approximately 2 to 15 mm in length, preferably approximately 2 to 8 mm in length. Thus, the isolation band comprises about 1.5 percent to about 5.9 percent of the length of the lower portion 54 of the device 42.

Any external noises or forces caused by tapping or rubbing the outer surface of the housing 12 are damped by the shock mount member 42 such that handling noise is reduced significantly. The isolation band 56 as described herein acts to decouple audio frequencies in the range of 60 to 100 Hz.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to extent required by the appended claims and the rules and principals of applicable law.

The invention claimed is:

1. A handheld microphone comprising:

a hollow cylindrical housing having a top end;

a cylindrical shock mount device having a lower portion positioned within the top end of the cylindrical housing and an upper portion extending outwardly beyond the top end of the cylindrical housing, the lower portion of the shock mount device having an isolation band such that only the isolation band of the lower portion of the shock mount device contacts an inner face of the housing and wherein the isolation band comprises about 1.5 percent to about 5.9 percent of the length of the lower portion of the device; and a dynamic element retained by the upper portion of the shock mount device.

2. The handheld microphone of claim 1 wherein the lower portion of the shock mount device has a generally convex outer surface forming the isolation band.

3. The handheld microphone of claim 1 wherein the isolation band comprises a ring within the lower portion of the shock mount device and wherein such ring has an outer diameter greater than the diameter of the lower portion of the shock mount device outside the ring.

4. The handheld microphone of claim 3 wherein the ring is integrally formed within the lower portion of the shock mound device.

5. The handheld microphone of claim 1 wherein the shock mount device is formed from a visco-elastic polymer.

6. The handheld microphone of claim 1 further comprising a magnet assembly housing the dynamic element, wherein the magnet assembly is seated into the upper portion of the shock mount device.

7. The handheld microphone of claim 6 further comprising a grille cap attached to the cylindrical housing and covering the dynamic element.

8. A microphone for receiving an acoustic signal and responsively providing an electrical signal to an output lead, the microphone being subjected to handling noises, comprising:

a hollow cylindrical housing having an open top end, a bottom end housing an output lead, and an interior face;

a cylindrical shock mount device having a lower portion positioned within the top end of the cylindrical housing and an upper portion extending outwardly beyond the top end of the cylindrical housing; and a microphone transducer positioned within the upper portion of the shock mount device for receiving the acoustic signal and responsively providing an electrical microphone signal to the output lead;

wherein the outer diameter of the lower portion of the shock mount device varies over the length of the lower portion forming an isolation band such that only the isolation band of the lower portion of the shock mount device contacts the interior face of the housing, and wherein the isolation band comprises about 1.5 percent to about 5.9 percent of the length of the lower portion of the device.

9. The handheld microphone of claim 8 wherein the lower portion of the shock mount device has a generally convex outer surface forming the isolation band.

10. The handheld microphone of claim 8 wherein the isolation band comprises a ring within the lower portion of the shock mount device and wherein such ring has an outer diameter greater than the diameter of the lower portion of the shock mount device outside the ring.

11. The handheld microphone of claim 10 wherein the ring is integrally formed within the lower portion of the shock mound device.

* * * * *